US005866861A

United States Patent [19]

Rajamani et al.

[11] Patent Number: 5,866,861

[45] Date of Patent: Feb. 2, 1999

[54] ELEVATOR ACTIVE GUIDANCE SYSTEM HAVING A MODEL-BASED MULTI-INPUT MULTI-OUTPUT CONTROLLER

[75] Inventors: Rajesh Rajamani, East Hartford; Timothy M. Remmers, Winsted; Randall K. Roberts, Amston, all of Conn.

[73] Assignee: Otis Elevator Company, Farmington, Conn.

[21] Appl. No.: 703,493

[22] Filed: Aug. 27, 1996

[51] Int. Cl.[6] ..... B66B 1/34; B66B 7/04

[52] U.S. Cl. ..... 187/292; 187/394; 187/409

[58] Field of Search ..... 187/394, 409, 187/410, 292

[56] References Cited

U.S. PATENT DOCUMENTS

| | | | |
|---|---|---|---|
| 4,750,590 | 6/1988 | Otala | 187/409 |
| 4,754,849 | 7/1988 | Ando | 187/409 |
| 5,020,639 | 6/1991 | Michel | 187/346 |
| 5,027,925 | 7/1991 | Kahkipuro | 187/292 |
| 5,086,882 | 2/1992 | Sugahara et al. | 187/410 |
| 5,117,946 | 6/1992 | Traktovenko et al. | 187/410 |
| 5,193,651 | 3/1993 | Shigeta et al. | 187/409 |
| 5,294,757 | 3/1994 | Skalski et al. | 187/393 |
| 5,304,751 | 4/1994 | Skalski et al. | 187/393 |
| 5,308,938 | 5/1994 | Roberts et al. | 187/393 |
| 5,321,217 | 6/1994 | Traktovenko et al. | 187/409 |
| 5,322,144 | 6/1994 | Skalski et al. | 187/393 |
| 5,329,077 | 7/1994 | Skalski et al. | 187/394 |
| 5,367,132 | 11/1994 | Skalski et al. | 187/393 |
| 5,400,872 | 3/1995 | Skalski et al. | 187/393 |
| 5,439,075 | 8/1995 | Skalski et al. | 187/410 |
| 5,524,730 | 6/1996 | Roberts | 187/292 |
| 5,652,414 | 7/1997 | Roberts et al. | 187/292 |

FOREIGN PATENT DOCUMENTS

| | | |
|---|---|---|
| 8133627 | 5/1996 | Japan . |
| 2262166 | 6/1993 | United Kingdom . |

OTHER PUBLICATIONS

"Attitude Control System of a Super–high Speed Elevator Car Based on Magnetic Guides" by H. Inaba, et al, presented at the IECON '94 of IEEE, Bologna, Italy, Sep. 5–9, 1994.

*Primary Examiner*—Robert E. Nappi

[57] ABSTRACT

In an elevator active guidance system, in order to avoid the action of one actuator (23) from interfering with the action of another, a controller (21) is provided that uses a force law based on a model of the elevator (40), and uses information from all of the sensors (22) in combination to determine, according to the force law, the force each actuator (23) should provide. The model of the elevator (40) is used to determine how the elevator (40) will respond to the forces exerted by the actuators (23). In the preferred embodiment, the elevator (40) is assumed to respond to the actuator forces as a rigid body. The full model is built up from this basic assumption, finally including all of the geometric and inertial attributes of the elevator necessary to describe its rigid body motion in response to forces from actuators (23).

3 Claims, 6 Drawing Sheets

ELEVATOR ACTIVE GUIDANCE SYSTEM HAVING A MODEL-BASED MULTI-INPUT MULTI-OUTPUT CONTROLLER

TECHNICAL FIELD

The present invention relates to elevators and more particularly, to active horizontal guidance as the elevator moves vertically along rails in a hoistway.

BACKGROUND OF THE INVENTION

Existing active horizontal guidance controllers use a simple control strategy that utilizes only local gap information to hold the elevator within a predetermined operating envelope, essentially a predetermined acceptable range in values of the position, velocity, and acceleration of the elevator. For controllers that are electromagnet-based, so-called active magnetic guidance (AMG) controllers, the electromagnetic actuators that produce forces in a particular direction at a particular guide-head use only the gap information for that direction at that particular guide-head. Since the forces produced by an actuator for one direction at one guide-head can produce motion at another guide-head or at the same guide-head in a transverse direction, when only information local to an actuator is taken into account by the controller, one actuator can interfere with another.

The controllers are often of the "proportional integral derivative" (PID) type. For these controllers, the control information utilized by the controller in determining actuator forces consists of the gap (determined from the position of the guide-head relative to the rail), the absolute velocity of the guide-head, and the integrated gap over time. Such a controller uses sensors to directly measure guide-head acceleration and gap, and infers velocity of the guide-head from its integrating acceleration over time. For each guide-head, acceleration and gap are usually sensed in two directions, called here the x and y-directions, which are mutually perpendicular and also both perpendicular to the direction of the hoistway, taken here to be in the z-direction.

In one embodiment of a global controller designed to use nonlocal information, a related patent application ("Active Magnetic Guidance for Elevators," filed Aug. 18, 1994, under U.S. Ser. No. 08/292,660) suggested the use of a "coordinated controller" in which gap information was expressed in terms of a set of coordinates especially suitable for the problem of describing the elevator cab motion. However, that invention did not base control of the elevator on knowledge of the dynamics of the elevator; the control law there is not model-based, and is not designed to avoid actuator-actuator interference.

DISCLOSURE OF THE INVENTION

The object of the present invention is to control the position and motion of an elevator relative to the guide-rails it moves along as it travels the length of a hoistway, doing so according to a force law that comma a set of actuators to pull the elevator toward the guide-rails with a force based on knowledge of the position and acceleration of a set of points of the elevator corresponding to the set of actuators, and based on knowledge of how the elevator as a whole will respond to the pulling forces exerted by the actuators.

According to the present invention, an active guidance system for an elevator in a hoistway having two guide-rails on opposing walls, the guide-rails lying in a direction parallel to a hoistway axis extending lengthwise along the hoistway, the elevator having attached to it four guide-heads for guiding the elevator along the guide-rails, comprises:

a) sensors responsive to absolute acceleration of the elevator and position of the elevator relative to the guide-rails at four locations in a first sensing direction transverse to the hoistway axis, and at two locations in a second sensing direction transverse to the hoistway axis, for providing control information signals indicative thereof, b) a controller, responsive to the control information signals, for providing a plurality of force command signals according to a force law, and c) a plurality of actuators, each responsive to a corresponding one of the force command signals, each for exerting positive and negative forces at a location and in a direction corresponding to a location and sensing direction of a corresponding sensor, wherein the force law determines a value of force for exertion by each actuator according to a model that relates geometry and inertia of the elevator to motion of the elevator caused by the forces exerted by the actuators.

A controller for such a system is here called a model-based multi-input multi-output (MIMO) controller, and, according to the present invention, can be a PID type controller. The controller holds the elevator position and motion within a predetermined acceptable range of values. It is model-based in that it determines what forces the actuator should exert is based on certain simplifying assumptions about the dynamical motion of the elevator cab, such as that the cab can be regarded as a rigid body with velocity-dependent damping of its motion transverse to the hoistway, and further based on determining, through measurement and experimentation, values for all the parameters of the model. The controller uses the model to calculate what actuator forces should be exerted to restore the elevator cab to position and motion within an acceptable operating envelope. It is multi-input in that the controller uses gap information from several actuator locations; and it is multi-output in that the same controller produces commands for the actuator associated with each sensor.

The upshot of this approach is that each actuator provides forces based not only on the gap information local to it, but on gap information globally, and uses this global information in a dynamical model to determine the precise value of the force each actuator should provide. In this approach, the actuators act in unison.

BRIEF DESCRIPTION OF THE DRAWINGS

An embodiment of the invention is described by way of example with reference to the accompanying drawings, in which.

BEST MODE FOR CARRYING OUT THE INVENTION

Figure 1:
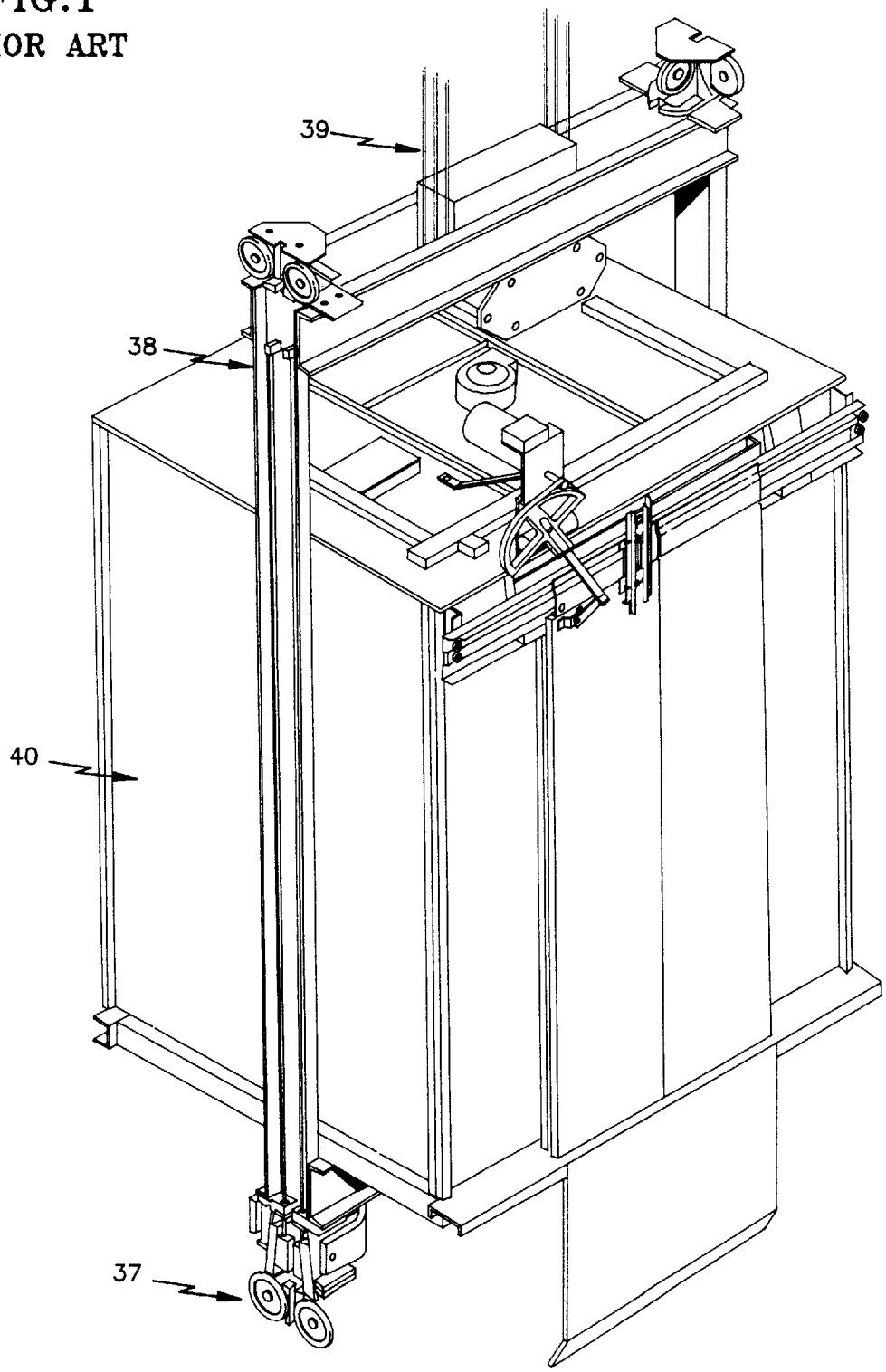
FIG. 1 PRIOR ART
FIG. 1 is a drawing of a conventional roller-guide elevator system.

FIG. 1, which illustrates prior art, shows an elevator cab 40 held in a rectangular frame 38; the cab is raised and lowered along guide-rails (not shown) by steel cables 39. In this prior art, the elevator cab is guided along the guide-rails by guide-wheels 37, which respond mechanically to the elevator cab moving off-track. The guide-rails are mounted on opposite hoistway walls and a motor in a machine room at the top of the building turns a sheave over which the cables are lain. A counterweight is attached to the other end of the cables.

Figure 2:
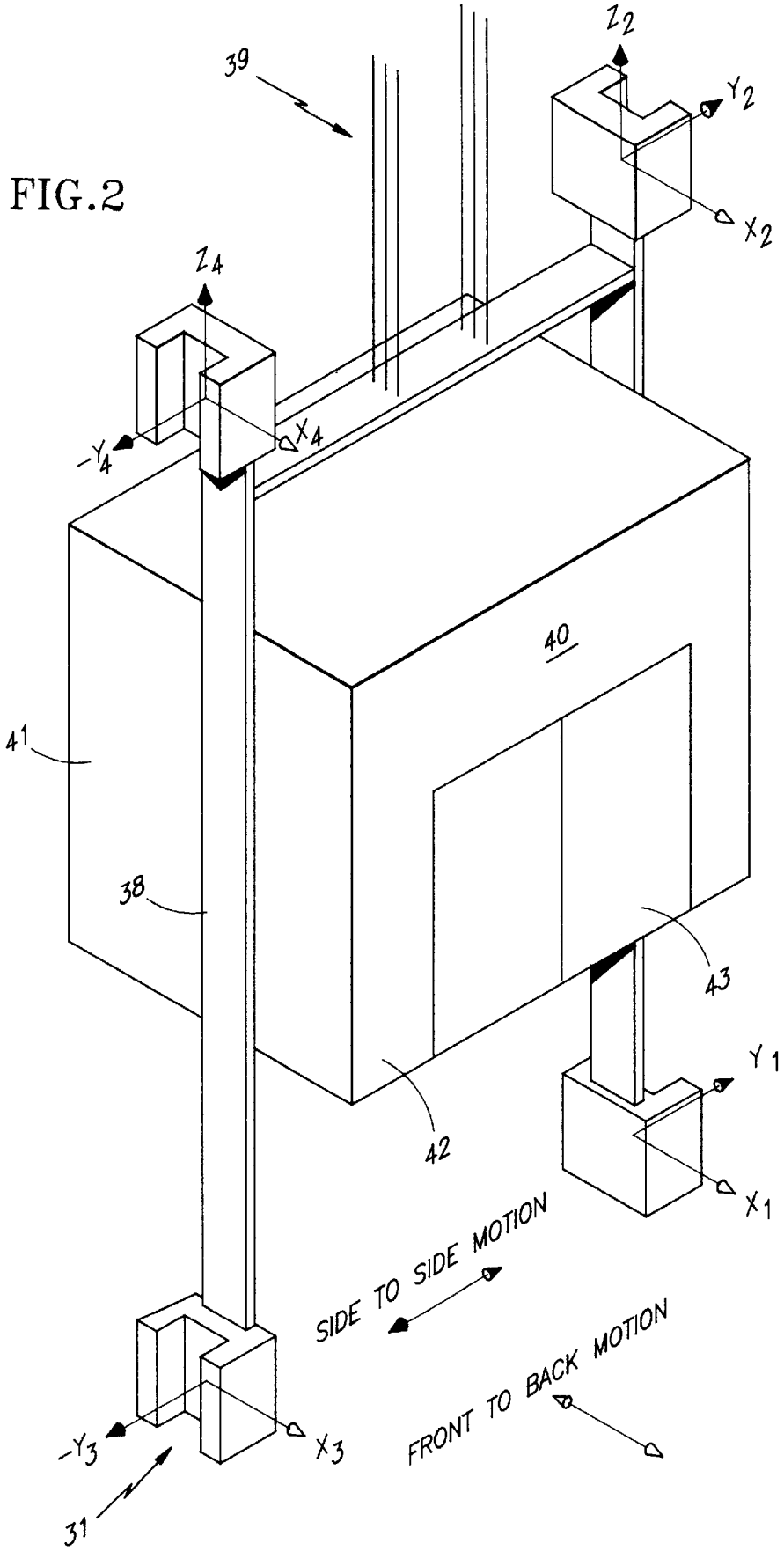
FIG. 2 is a drawing of an active magnetic guidance controlled elevator system according to both prior art and the present invention.

FIG. 2 shows an elevator system with the coordinates used in the model of the preferred embodiment. There are four guide-heads 31 affixed to the frame 38. The actuators are electromagnet-based in the preferred embodiment, and are located on the guide-heads. These actuators produce forces at each guide-head in the x-direction for countering side-to-side motion, and in the y-direction for countering front-to-back motion, as directed by the controller according to the present invention.

Figure 3:
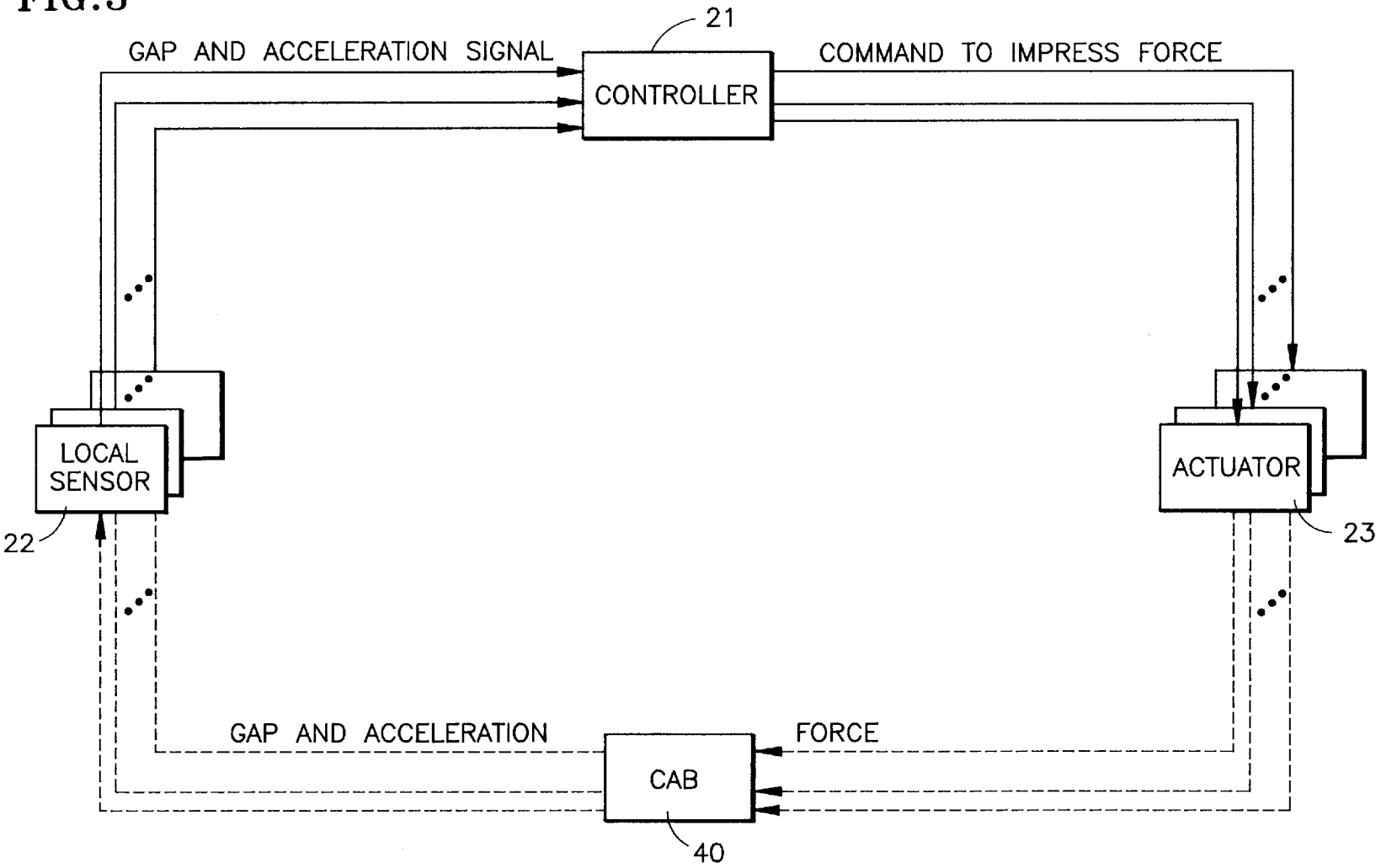
FIG. 3 shows a controller according to the present invention responsive to a sensed local signal relating to a cab for providing a command signal to an actuator to impress a force.

Referring now to FIG. 3, a controller 21 according to the present invention responds to gap information from several local sensors 22, each having a corresponding actuator 23. Based on the information from all of the local sensors, the controller calculates the force each actuator should provide by using the model of the elevator cab, thereby holding the elevator motion within a predetermined operating envelope of acceptable position and motion.

Figure 4:
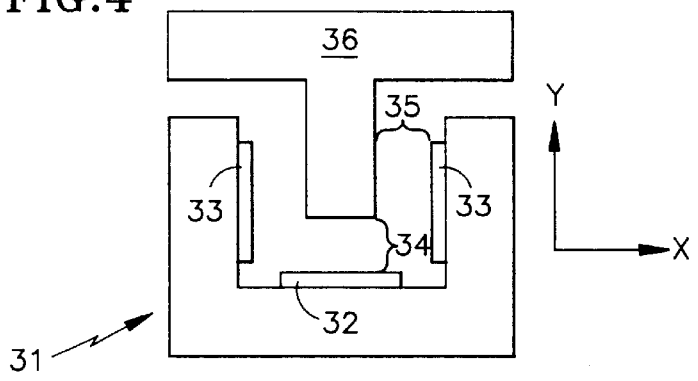
FIG. 4 is a top view of a typical active magnetic guidance system guide-head and the corresponding guide-rail according to both prior art and the present invention.

FIG. 4 shows how electromagnetic actuators can be affixed to a guide-head 31 to move it farther from, or closer to, a guide-rail 36 in the two transverse directions, front-to-back (x-direction) and side-to-side (y-direction). Two front-to-back electromagnets 33 on one guide-head are used to provide an x-actuator; whereas one electromagnet 32 on one guide-head and its oppositely oriented electromagnet on the other guide-head on the other guide-rail, at the same height along the hoistway, is used to form a single y-actuator. Thus, eight electromagnets make four x-actuators, and four electromagnets make two y-actuators. Each such actuator is capable of exerting a force that is positive or negative, controlled by simply turning on one or the other electromagnet of the pair that make up the actuator. The side-to-side (x-direction) gap 34 and front-to-back (y-direction) gap 35 are often measured with air-gap sensors but can be measured in any convenient manner. Side-to-side and front-to-back acceleration of each guide-head are often measured with an accelerometer.

Figure 5:
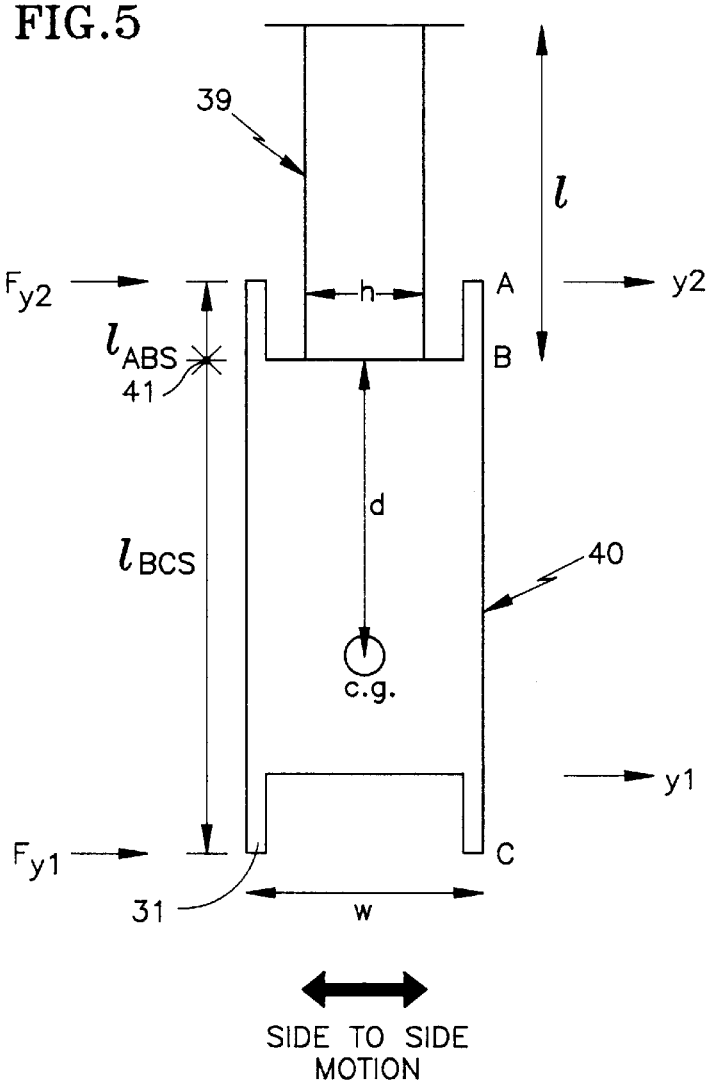
FIG. 5 is a schematic of the side-to-side motion, or y-direction motion, of an elevator cab illustrating some of the coordinates used in the model of the present invention.

Referring now to FIG. 5, the two y-actuators that act on the cab to cause side-to-side motion are shown. In this description the y-actuators are associated with the sensors at guide-heads with coordinates having numbered subscripts one and two in FIG. 2 are used. Thus, in this control system, side-to-side motion is countered with only two forces $F_{y1}$ and $F_{y2}$, either of which can be positive or negative.

Figure 6:
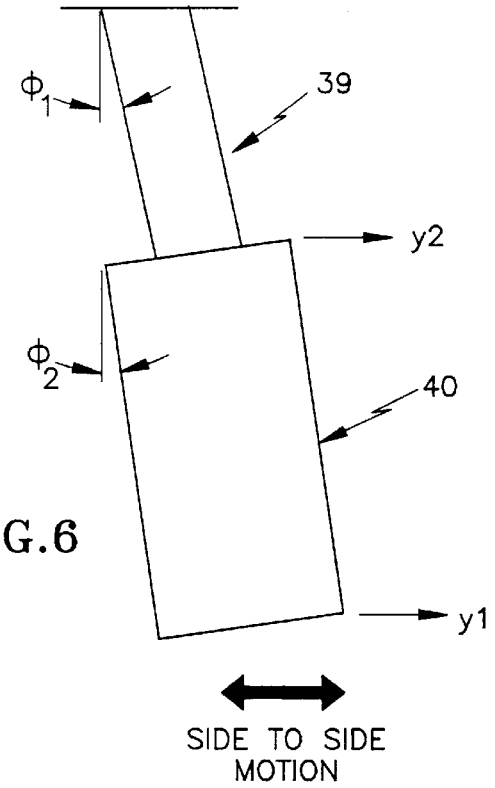
FIG. 6 is another schematic of side-to-side motion, showing both Cartesian coordinates ($y_1$, $y_2$) and generalized coordinates ($\phi_1$, $\phi_2$) used to describe that motion.

FIG. 6 also shows what are here called generalized coordinates ($\phi_1$, $\phi_2$) used to describe the side-to-side motion of the elevator cab. These coordinates are related to the (directly measured) Cartesian coordinates ($y_1$, $y_2$), which could also be used to describe the side-to-side motion but which make the equations of motion more complicated.

Figure 7:
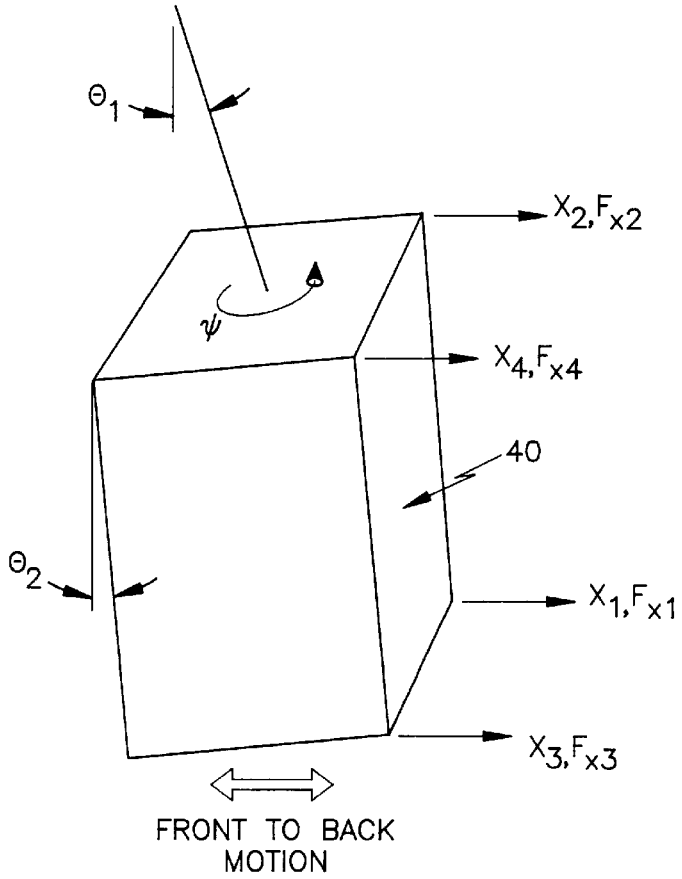
FIG. 7 is a schematic of the front-to-back motion, or x-direction motion, of an elevator cab showing both the Cartesian coordinates ($x_1$, $x_2$, $x_3$, $x_4$) and the generalized coordinates ($\theta_1$, $\theta_2$, $\psi$) used in the model of the present invention.

Referring to FIG. 7, the second type of motion is in the front-to-back direction, or x-direction, countered by forces $F_{x1}$, $F_{x2}$, $F_{x3}$ and $F_{x4}$ produced by x-actuators at guide-heads with numbered subscripts one through four in FIG. 2. FIG. 7 also shows the three generalized coordinates ($\theta_1$, $\theta_2$, $\psi$) needed to describe the front-to-back motion assuming the elevator cab is a rigid body.

Referring now to FIGS. 5, 6 and 7, the geometry and force diagram for the equations of motion ignoring damping for side-to-side and front-to-back motion are shown. In these equations, the acceleration due to gravity is represented by g, Young's modules for stretching of the steel cables is represented by E, and the cross sectional area of each of the steel cables is represented by A. Finally $I_x$, $I_y$, $I_z$, are the moments of inertia of the elevator cab for rotation about the x, y, and z axis, respectively, passing through the center of mass of the elevator cab. The lengths $1_{ABS}$ and $1_{ABF}$ are between the hitch 41 (FIG. 5) and the top side-to-side actuator and top front-to-back actuators, respectively. Similarly, the lengths $^1$BCS and $^1$BCF are between the hitch 41 and the bottom side-to-side actuator and the bottom front-to-back actuators, respectively.

Thus the equations for side-to-side motion, or motion in the y-direction, are $$Ml^2\phi_1+Mgl\phi_1=(F_{y1}+F_{y2})l$$

$$(Md^2+I_x)\ddot{\phi}_2+\left(Mgd+\frac{AEh^2}{2l}\right)\phi_2=-F_{y2}l_{ABS}+F_{y1}l_{BCS}$$

where the sensor-measured gaps $y_1$ and $y_2$ are related to $\phi_1$ and $\phi_2$ by the equations $$y_1=l\phi_1+l_{BCS}\phi_2$$

$$y_2=l\phi_1-l_{ABS}\phi_2$$

which define a transformation between the generalized and Cartesian coordinates for side-to-side motion.

The overall dynamics of the front-to-back motion, which is motion in the x-direction, can be described by the equations $$Ml^2\theta_1+Mgl\theta_1=(F_{x1}+F_{x2}+F_{x3}+F_{x4})l$$

$$(Md^2+I_y)\ddot{\theta}_2+\left(Mgd+\frac{AEh^2}{2l}\right)\theta_2=-(F_{x2}+F_{x4})l_{ABF}+(F_{x1}+F_{x3})l_{BCF}$$

$$I_z\ddot{\psi}=-(F_{x1}+F_{x2})\frac{w_y}{2}+(F_{x3}+F_{x4})\frac{w_y}{2}$$

where the four sensor measurements $x_1$, $x_2$, $x_3$ and $x_4$ are related to the (generalized coordinates) angles $\theta_1$, $\theta_2$ and $\psi$ by the equations $$x_1 = l\theta_1 + l_{BCF}\theta_2 + \frac{w_y}{2}\psi$$

$$x_2 = l\theta_1 - l_{ABF}\theta_2 + \frac{w_y}{2}\psi$$

$$x_3 = l\theta_1 + l_{BCF}\theta_2 - \frac{w_y}{2}\psi$$

$$x_4 = l\theta_1 - l_{ABF}\theta_2 - \frac{w_y}{2}\psi$$

which defines a transformation between the generalized and Cartesian coordinates for front-to-back motion.

The dynamical equations for front-to-back and side-to-side motion can be combined into one matrix equation. Using the linear array Q to represent all of the generalized coordinates, and the linear array H to represent all of the actuator forces calculated by the controller, so that $$Q = \begin{bmatrix} \phi_1 \\ \phi_2 \\ \theta_1 \\ \theta_2 \\ \psi \end{bmatrix} \text{ and } H = \begin{bmatrix} F_{y1} \\ F_{y2} \\ F_{x1} \\ F_{x2} \\ F_{x3} \\ F_{x4} \end{bmatrix}$$

the dynamical equation can be written in matrix form as $$M\ddot{Q}=KQ+C\dot{Q}+BH$$

with matrices M, K, and B defined by the dynamical model, i.e. with elements set equal to the appropriate terms in the dynamical equations for front-to-back and side-to-side motions as written in non-matrix form above. In addition, the matrix C has as its elements coefficients that represent damping of the transverse motion of the cab (front-to-back and side-to-side motion) in proportion to its transverse velocity. These coefficients are derived from experimental measurements. The linear array H can also be used to represent direct disturbance forces acting on the elevator, such as aerodynamic wind forces.

Using the notation $G=(y_1-y_{r1}, y_2-y_{r2}, x_1-x_{r1}, x_2-x_{r2}, x_3-x_{r3}, x_4-x_{r4})$ to represent the measured gaps, here accounting for rail irregularities using $R=(y_{r1}, y_{r2}, x_{r1}, x_{r2}, x_{r3}, x_{r4})$ where each component of the column matrix R is a z-dependent constant of the elevator system, the equations of the coordinate transformation between the gap measurements G and the generalized coordinates Q can be written in matrix form as $$G=TQ-R$$

where T is the 6×5 transformation matrix defined by the above equations that relate the Cartesian gaps to the generalized coordinates for both front-to-back and side-to-side motion.

With this notation, the forces to be provided by each actuator, according to the model-based MIMO controller in the preferred embodiment of the present invention, are given by $$H=-B^{-1}M[K_PT^{-1}G+K_D\ddot{Q}+K_1T^{-1}\int Gdt]-B^{-1}[KQ+C\dot{Q}]$$

where $K_P$, $K_D$, and $K_I$ are 5×5 diagonal matrices with diagonal elements determined as described below.

With this choice of the control law, the dynamical equation becomes, in matrix form, $$M[\ddot{Q}+K_PQ+K_D\dot{Q}+K_I\int Qdt]=M[K_PT^{-1}R+K_IT^{-1}\int Rdt]$$

and by eliminating the common factor, matrix M, the system of dynamical equations becomes five uncoupled non-homogeneous integro-differential equations.

To use this force law it is necessary to determine values for the (diagonal) elements of $K_P$, $K_D$, and $K_I$. These are determined by setting the right-hand side of the equation to zero. This results in five uncoupled homogeneous integro-differential equations, which, in matrix form, is a system-independent control equation $$\ddot{Q}+K_D\dot{Q}+K_PQ+K_I\int Qdt=0$$

with Q(t) as the unknown, representing motion of the elevator in terms of the generalized coordinates in the absence of rail irregularities. For instance, the equation for $\phi_1$ becomes $$\phi_1+k_{d1}\dot{\phi}_1+k_{p1}\phi_1+k_{i1}\int\phi_1dt=0$$

where the variables $k_{d1}$, $k_{p1}$, and $k_{i1}$ are the 1-1 (diagonal) elements of $K_D$, $K_P$ and $K_I$ respectively, and are chosen so as to hold the elevator to within a predetermined operating envelope with respect to the generalized coordinate $\phi_1$.

In the present context, the term operating envelope refers to an acceptable range in the position, velocity, and acceleration of the elevator in each generalized coordinate, each generalized coordinate corresponding to a different degree of freedom of the elevator according to the model used. From the point of view of the sensors at each guide-head, the controller should aim to hold a nominal gap at each guide-head, it should respond with a minimum force from the actuators to an off-balancing force, such as from an imbalance in load tending to tilt the elevator, and it should respond so as to move the elevator back to the nominal gap without causing the elevator to vibrate internally i.e. in non-rigid body (elastic) modes of vibration.

In practice, the values of the (diagonal) elements of the matrices $K_D$, $K_P$ and $K_I$ are chosen by transforming each of the individual integro-differential equations represented by the system-independent control equation into an algebraic equation, using, for example, a Laplace transform. Then to hold the elevator within the operating envelope, the values of the (diagonal) elements of $K_D$, $K_P$ and $K_I$ are chosen, according to the teaching of the present invention, so that, first, the algebraic equation has its poles in the left-half complex plane. Next, values of the $K_P$ elements are chosen to ensure necessary minimum spring rates, and the $K_I$ elements are chosen to set how fast the controller should center the elevator if it moves off-center because of an imbalance in load. Finally, the $K_D$ elements are chosen to be as large as possible, but not so large as to cause the cab to vibrate as an elastic deformable body. To avoid exciting these modes of vibration, which are higher in frequency than the rigid body oscillatory motion of the cab, the elements of $K_D$ must be kept below a threshold that depends on the elevator. Consistent with this constraint on $K_D$, the elements of $K_P$ and $K_I$ are chosen to be above minimum values preset by the user so that the poles of the equations derived by Laplace transform of the integro-differential equations for each of the generalized coordinates have as negative a real part as possible.

Figure 8:
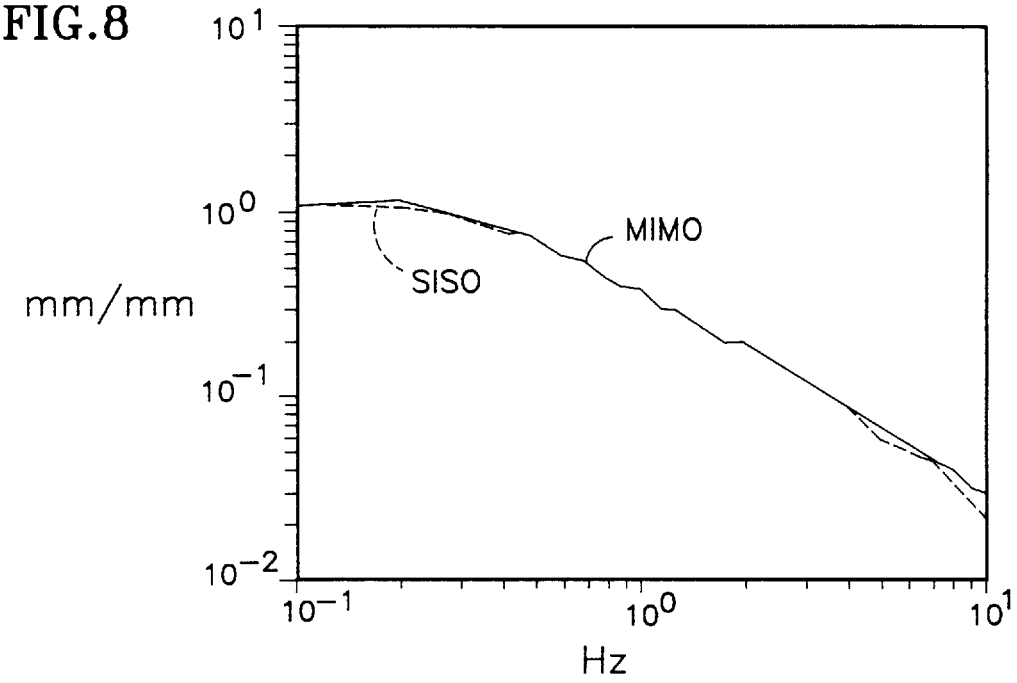
FIG. 8 is a predicted comparison of performance under rail disturbance between a conventional single-input single-output controller and the model-based MIMO controller of the present invention.
Figure 9:
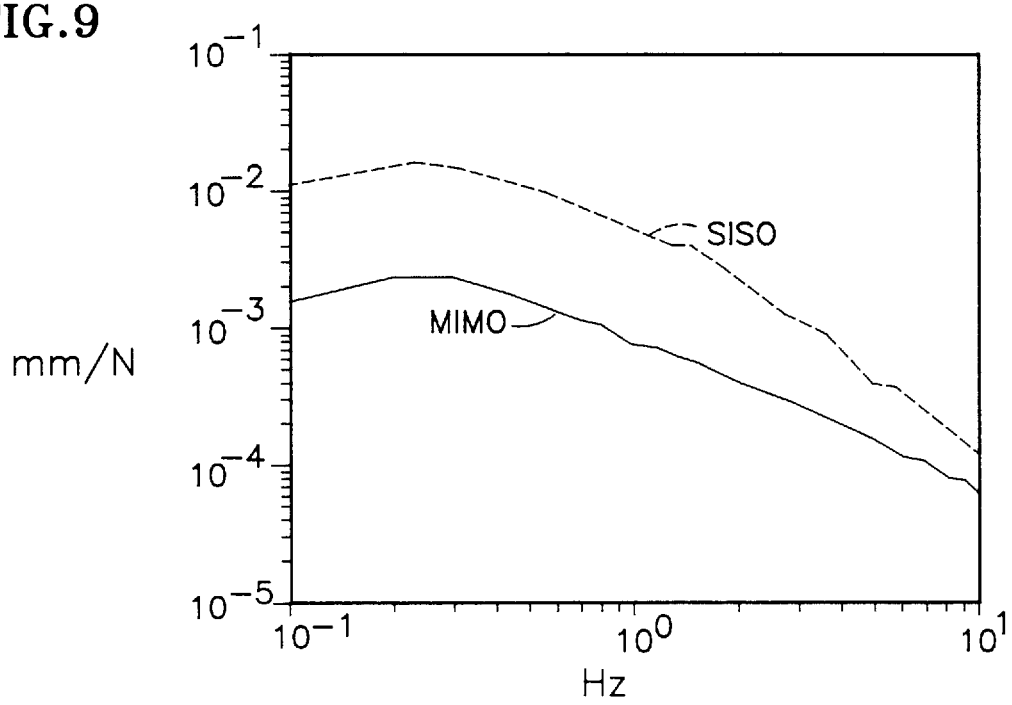
FIG. 9 is the predicted comparison of performance under wind disturbance between a conventional single-input single-output controller and the model-based MIMO controller of the present invention.

FIGS. 8 and 9 show a prediction of how a single-input single-output (SISO) controller would perform compared to a model-based MIMO controller according to the present invention. The two kinds of controllers in this comparison have been tuned to yield approximately the same level of performance with a rail disturbance input, as shown in FIG. 8. The displacement of the elevator per unit rail disturbance is seen to be the same at all frequencies for both controllers. As shown in FIG. 9, for the same set of gains, the model-based MIMO controller yields far superior performance when a wind disturbance is imposed. The displacement per unit of wind force is seen to be almost an order of magnitude less in the case of the model-based MIMO controller compared to the SISO controller. The model-based MIMO controller in this case also has a 6 db gain margin and a 40° phase margin.

Although the invention has been shown and described with respect to a best mode embodiment, it should be understood by those skilled in the art that the foregoing and various other changes, omissions and additions in the form and detail thereof may be made without departing from the spirit and scope of the invention.

Having now disclosed the invention, what is claimed is:

1. An active guidance system for an elevator in a hoistway having two guide-rails on opposing walls, the guide-rails lying in a direction parallel to a hoistway axis extending lengthwise along the hoistway, the elevator having attached to it four guide-heads for guiding the elevator along the guide-rails, the active guidance system comprising:

a) sensors responsive to absolute acceleration of the elevator and position of the elevator relative to the guide-rails at four locations in a first sensing direction transverse to the hoistway axis, and at two locations in a second sensing direction transverse to the hoistway axis, for providing control information signals indicative thereof, b) a controller, responsive to the control information signals, for providing a plurality of force command signals according to a force law, and c) a plurality of actuators, each responsive to a corresponding one of the force command signals, each for exerting positive and negative forces at a location and in a direction corresponding to a location and sensing direction of a corresponding sensor, wherein the force law determines a value of force for exertion by each actuator according to a model that relates geometry and inertia of the elevator to motion of the elevator caused by the forces exerted by the actuators, wherein the model is of a rigid body with damping of motion transverse to the hoistway axis, and so uses a dynamical equation $$M\ddot{Q}=KQ+C\dot{Q}+BH$$

to predict the motion of the elevator transverse to the hoistway axis, where

Q is a five-component column matrix of generalized coordinates that in combination describe the elevator motion transverse to the hoistway axis, and is related to a six-component column matrix G of gap values indicated by the sensors according to a transformation equation G=TQ−R, in which T is a six-by-five matrix determined from the geometry of the elevator and R is a six-component column matrix representing rail irregularities corresponding to each sensor;

H is a six-component column matrix, one component for each actuator, each component having a value representing the magnitude and direction of force each actuator is to provide;

B is a five-by-six matrix, with components calculated from the geometry of the elevator, that relates forces applied by the actuators to the motion of the elevator expressed in the generalized coordinates;

M and K are five-by-five matrices, M having calculated components depending on inertia of the elevator and K having calculated components depending on restoring torques acting on the elevator; and C is a five-by-five matrix having components representing damping of motion of the elevator in the first and second sensing directions transverse to the hoistway axis.

2. The active guidance system as recited in claim 1, wherein the force law is $$H=-B^{-1}M[K_PT^{-1}G+K_D\dot{Q}+BK_IT^{-1}\int Gdt]-B^{-1}[KQ+C\dot{Q}]$$

where $K_P$, $K_D$, and $K_I$ are five-by-five diagonal matrices with elements chosen so that a system independent control equation $$\ddot{Q}+K_D\dot{Q}+K_PQ+K_I\int Qdt=0$$

has a solution Q representing motion of the elevator in the first and second sensing direction transverse to the hoistway axis within a predetermined operating envelope.

3. An active guidance system as recited in claim 2, wherein each actuator comprises two electromagnets oriented and positioned for pulling the elevator along a same line in opposite directions.

* * * * *